US008393267B2

(12) United States Patent
Kucaba et al.

(10) Patent No.: US 8,393,267 B2
(45) Date of Patent: Mar. 12, 2013

(54) DISPOSABLE CUP INSERT FOR PAD PRINTING AND DECORATING

(75) Inventors: Tracy Kucaba, South Elgin, IL (US); Dana Pulvino, Crystal Lake, IL (US); Robert Hitchcock, West Chicago, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 461 days.

(21) Appl. No.: 11/617,402

(22) Filed: Dec. 28, 2006

(65) Prior Publication Data

US 2007/0157833 A1 Jul. 12, 2007

Related U.S. Application Data

(60) Provisional application No. 60/754,717, filed on Dec. 29, 2005.

(51) Int. Cl.
*B41F 17/00* (2006.01)

(52) U.S. Cl. ..... 101/41; 101/169; 101/170; 101/364

(58) Field of Classification Search ..... None
See application file for complete search history.

(56) References Cited

U.S. PATENT DOCUMENTS

| | | | | | |
|---|---|---|---|---|---|
| 2,382,103 | A | * | 8/1945 | Sandman | 101/365 |
| 3,094,924 | A | * | 6/1963 | Stark | 101/364 |
| 3,318,239 | A | | 5/1967 | Wintzer | |
| 4,092,922 | A | * | 6/1978 | Schweitzer | 101/363 |
| 4,393,775 | A | | 7/1983 | Cappel et al. | |
| 4,432,282 | A | | 2/1984 | Jurinak | |
| 4,557,195 | A | | 12/1985 | Phlipp | |
| 4,905,594 | A | * | 3/1990 | Phillip et al. | 101/163 |
| 4,945,831 | A | | 8/1990 | Buan et al. | |
| 5,003,872 | A | | 4/1991 | Dalferth | |
| 5,042,381 | A | * | 8/1991 | Thompson et al. | 101/364 |
| 5,259,878 | A | | 11/1993 | Buan et al. | |
| 5,272,972 | A | | 12/1993 | Tobita | |
| 5,272,973 | A | * | 12/1993 | Chojnacki | 101/163 |
| 5,320,037 | A | | 6/1994 | Harris | |
| 5,392,706 | A | | 2/1995 | Drew, II et al. | |
| 5,476,040 | A | | 12/1995 | Kleist | |
| 5,577,442 | A | | 11/1996 | Tanaka et al. | |
| 5,582,350 | A | | 12/1996 | Kosmyna et al. | |
| 5,664,496 | A | * | 9/1997 | Scheuhing et al. | 101/169 |
| 5,746,129 | A | | 5/1998 | Murray | |
| 5,816,501 | A | | 10/1998 | LoPresti et al. | |

(Continued)

FOREIGN PATENT DOCUMENTS

| | | |
|---|---|---|
| CN | 2691849 Y | 4/2005 |
| DE | 2250092 A1 | 4/1974 |

(Continued)

*Primary Examiner* — Jill Culler
(74) *Attorney, Agent, or Firm* — Christopher R. Carroll; The Small Patent Law Group, LLC

(57) ABSTRACT

A liquid supply assembly for use with a printing system of a type in which a liquid is deposited from the liquid supply assembly in a receiving region on a plate and any excess of the liquid in the receiving region is scraped from the plate by the liquid supply assembly. To this end, the liquid supply assembly employs a reusable cup, a disposable cup insert and a scraping element. As assembled, the reusable cup includes a reusable liquid reservoir, the disposable cup insert includes a temporary liquid reservoir holding the liquid within the reusable liquid reservoir, and the scraping element includes a conduit facilitating a flow of the liquid held by the temporary liquid reservoir through the conduit to the plate.

12 Claims, 8 Drawing Sheets

U.S. PATENT DOCUMENTS

| | | | | |
|---|---|---|---|---|
| 6,129,012 | A * | 10/2000 | Dietz et al. | 101/41 |
| 6,170,696 | B1 | 1/2001 | Tucker et al. | |
| 6,467,647 | B1 | 10/2002 | Tucker et al. | |
| 6,752,179 | B1 | 6/2004 | Schwartz | |
| 6,910,599 | B2 | 6/2005 | Tucker et al. | |
| 2005/0155968 | A1 | 7/2005 | Kosmyna et al. | |
| 2005/0258271 | A1 | 11/2005 | Kosmyna et al. | |
| 2005/0263614 | A1 | 12/2005 | Kosmyna et al. | |

FOREIGN PATENT DOCUMENTS

| | | | |
|---|---|---|---|
| DE | 8809563 | | 9/1988 |
| DE | 9006932 | | 8/1990 |
| DE | 19644366 | A1 | 4/1998 |
| EP | 0315769 | A2 | 5/1989 |
| EP | 1033246 | | 9/2000 |
| EP | 1247647 | | 10/2002 |

* cited by examiner

DISPOSABLE CUP INSERT FOR PAD PRINTING AND DECORATING

BACKGROUND OF THE INVENTION

This application claims the benefit of U.S. Provisional Patent Application 60/754,717 filed Dec. 29, 2005, the entirety of which is incorporated herein by reference.

The present invention relates to liquid supply assemblies for printers. More particularly, the present invention relates to a disposable cup insert as a temporary reservoir designed to hold a liquid (e.g., a liquid mixture of ink and thinner) used in a pad printing and decorating process.

Automated printing systems are in widespread use in a host of industries. And, the number of types of printing systems is almost as great as the number of industries in which these systems are used.

One type of printing system that operates in a fully automatic or near fully automatic mode is a pad printing system. These systems are used to apply high quality print (e.g., indicia) on flat as well as non-flat surfaces. For example, pad printing systems can be used to print logos and the like on cellular telephone covers, game balls (e.g., golf balls) and the like. It will be appreciated that such printing must be carried out, not only on a spherical surface, but on a surface that is formed with dimples as well.

Conventional pad printing systems use a deformable pad which receives ink, transferred as an image, from a flat cliché plate. The plate has an engraving or etching of the indicia formed therein. Ink is transferred from a liquid supply assembly to the cliché plate, and fills into the etched areas. The deformable pad is then pressed onto the plate and ink within the liquid is picked up by the pad. The image is then transferred to the curved surface which is to be printed.

To re-ink the pad, in a commonly used arrangement, an inverted cup containing a quantity of printing ink is used to apply the ink to the cliché plate. To apply a new coating of ink to the cliché plate, the cup and cliché plate are moved relative to each other following each ink transfer operation. A doctor blade is fitted to the cup to traverse along the cliché plate and "wipe" excess ink from the cliché plate. This assures that ink is left behind in the etching but does not build up on the plate, inside or outside of the etched areas.

Currently, the cup is typically cleaned after each use of the cup in applying a new coating of ink to the cliché plate. Such cleaning can be costly in terms of time, labor and materials. Accordingly, there is a need for a liquid supply assembly for a printing system that minimizes, if not eliminates, a cleaning requirement of the reusable cup after each of use of the cup in applying a new coating of ink to the cliché plate.

SUMMARY OF THE INVENTION

The present invention provides a new and unique liquid supply assembly employing a reusable cup including a reusable liquid reservoir, a disposable cup insert including a temporary liquid reservoir for holding a liquid within the reusable liquid reservoir, and a scraping element including a conduit in liquid communication with the temporary liquid reservoir of the disposable cup insert. This liquid assembly is designed to be used by a printing system of the type in which the reusable cup is secured by the printer system whereby the liquid held by the temporary liquid reservoir of the disposable cup insert can be deposited by the conduit in a receiving region on a plate and any excess of the liquid in the receiving region can be scraped from the plate by the scraping element.

The disposable cup insert includes a hollow reservoir body having an open outlet and a closed base defining the temporary liquid reservoir.

In a first form of the disposable cup insert, the closed base has a flexible material composition to facilitate an expansion of the temporary liquid reservoir in response to an increase in a gas pressure exerted by the liquid on the temporary liquid reservoir.

In a second form of the disposable cup insert, the open outlet includes a seal enclosing the conduit of the scraping element.

In a third form of the disposable cup insert, the open outlet includes a hinge facilitating movement of the scraping element relative to the disposable cup insert.

These and other features and advantages of the present invention will be readily apparent from the following detailed description, in conjunction with the claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
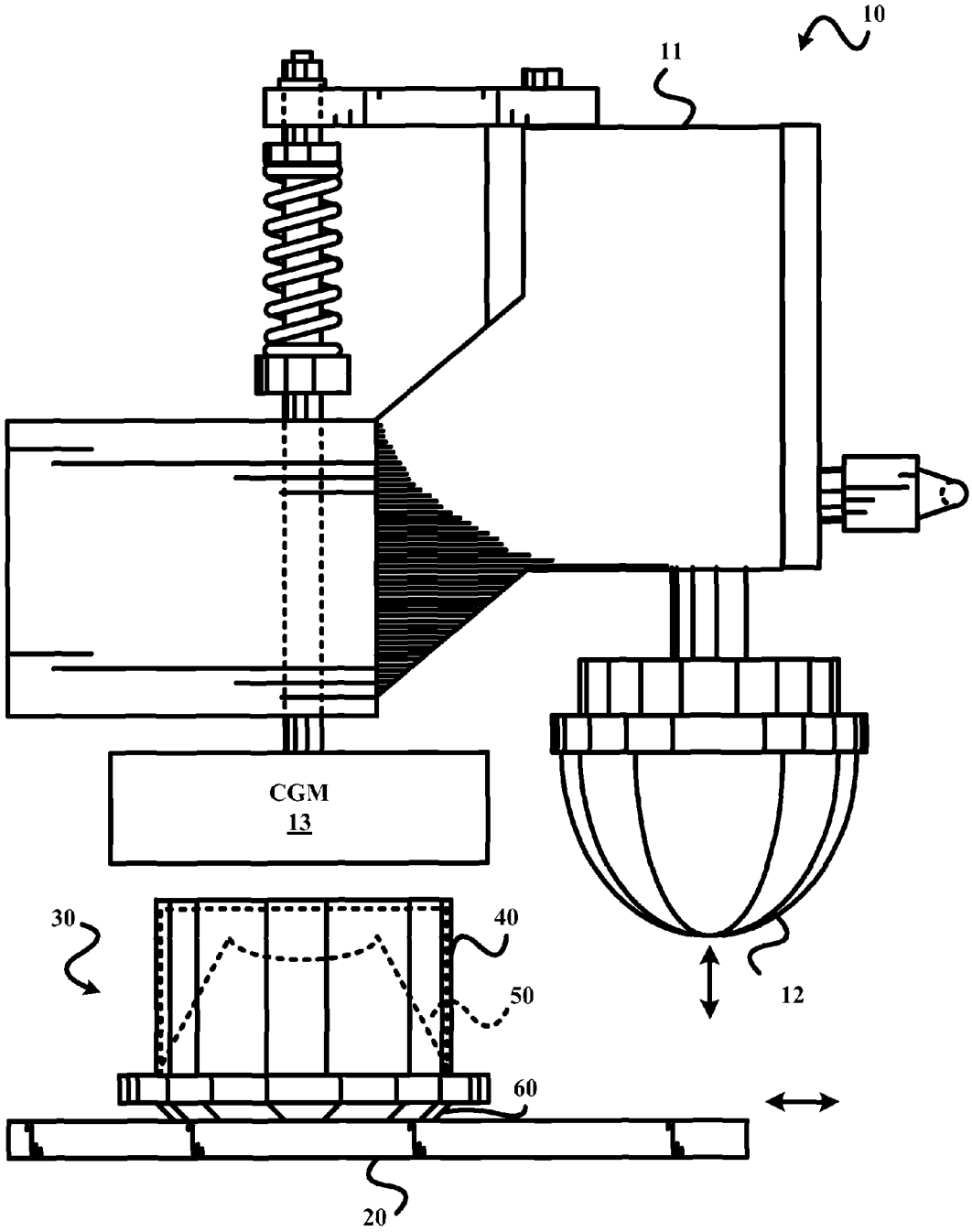
FIG. 1 illustrates a side view of one embodiment of a liquid supply assembly in accordance with the present invention as employed in a pad printing system further employing a printing pad and a cliché plate as known in the art.

While the present invention is susceptible of embodiment in various forms, there is shown in the drawings and will hereinafter be described as presently preferred embodiments with the understanding that the presently preferred embodiments are to be considered an exemplification of the present invention and are not intended to limit the present invention to the specific embodiments illustrated.

It should be understood that the title of this section of this specification, namely, "Detailed Description Of the Invention", relates to a requirement of the United States Patent Office, and does not imply, nor should be inferred to limit the subject matter disclosed herein.

Referring now to the drawings, FIG. 1 illustrates a portion of an exemplary pad printer 10 including a frame 11 having a reciprocating printing pad 12 mounted thereto. Printing pad 12 is a deformable pad onto which ink is transferred, and from which the ink is further transferred to the object to be imprinted. A typical printing pad 12 is formed from a resilient, low permeability material such as silicone rubber or the like.

Also shown are a cliché plate 20, which has the artwork in the form of an engraving or etching, and a liquid supply assembly 30, which is secured by a cup gripping mechanism ("CGM") 13 of pad printer 10 whereby cliché plate 20 and liquid supply assembly 30 can be reciprocated relative to one another to supply a liquid held by the liquid supply assembly 30 to cliché plate 20 (e.g., ink from an ink/thinner liquid mixture). To this end, liquid supply assembly 30 includes a reusable cup 40, a disposable cup insert 50 inserted within reusable cup 40, and a scraping element in the form of a doctor ring 60. In operation, cup gripping mechanism 13 secures reusable cup 40 as would be appreciated by those having ordinary skill in the art whereby, as the liquid supply assembly 30 and/or cliché plate 20 are being translated in a horizontal direction, liquid held by disposable cup insert 50 can be deposited in a receiving region on cliché plate 20 and any excess of the liquid can be scraped from cliché plate 20 by doctor ring 60 to thereby leave liquid in the receiving region only of cliché plate 20.

Figure 2:
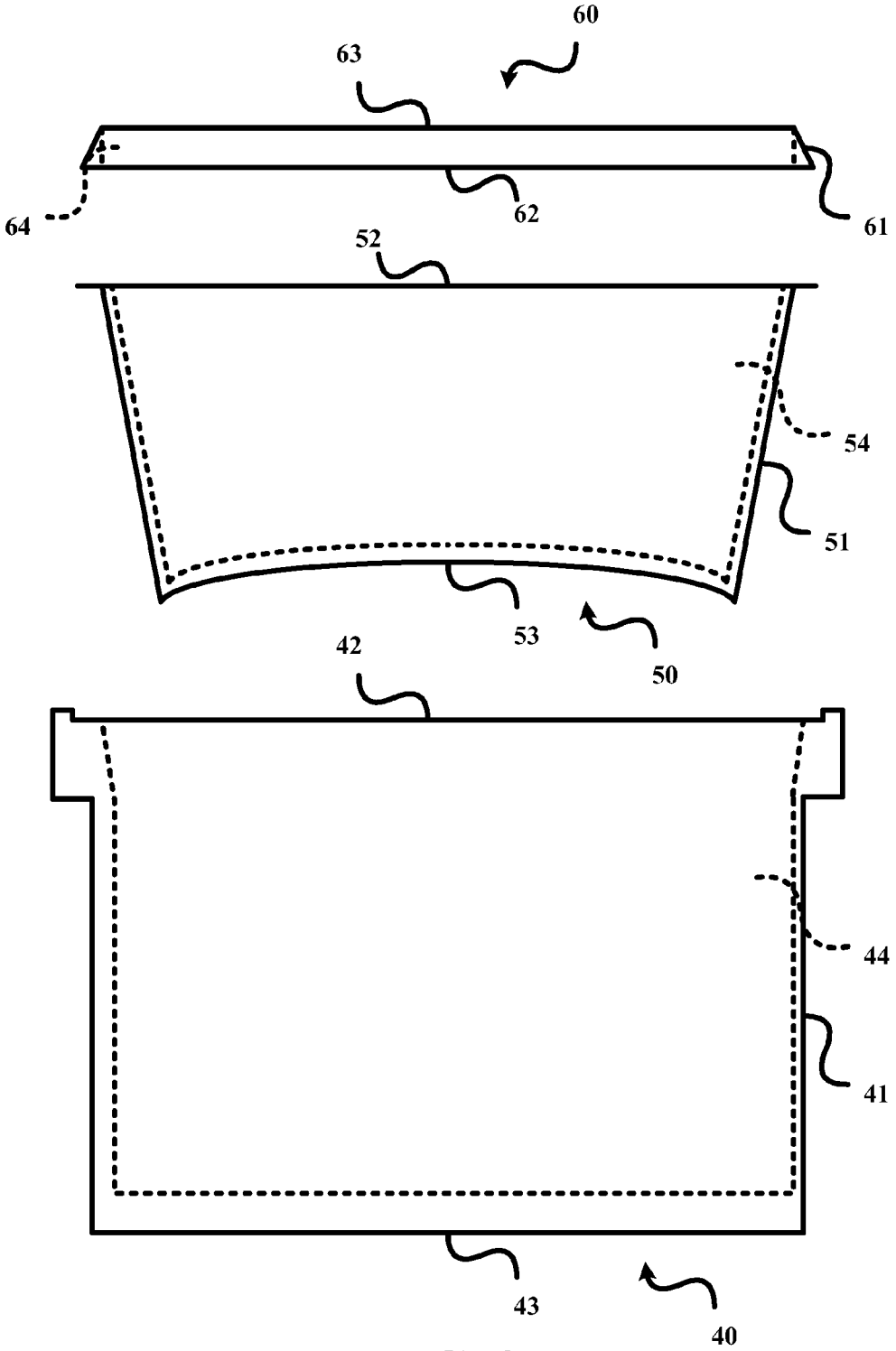
FIG. 2 illustrates an exploded side view of the liquid supply assembly illustrated in FIG. 1 in accordance with the present invention.
Figure 3:
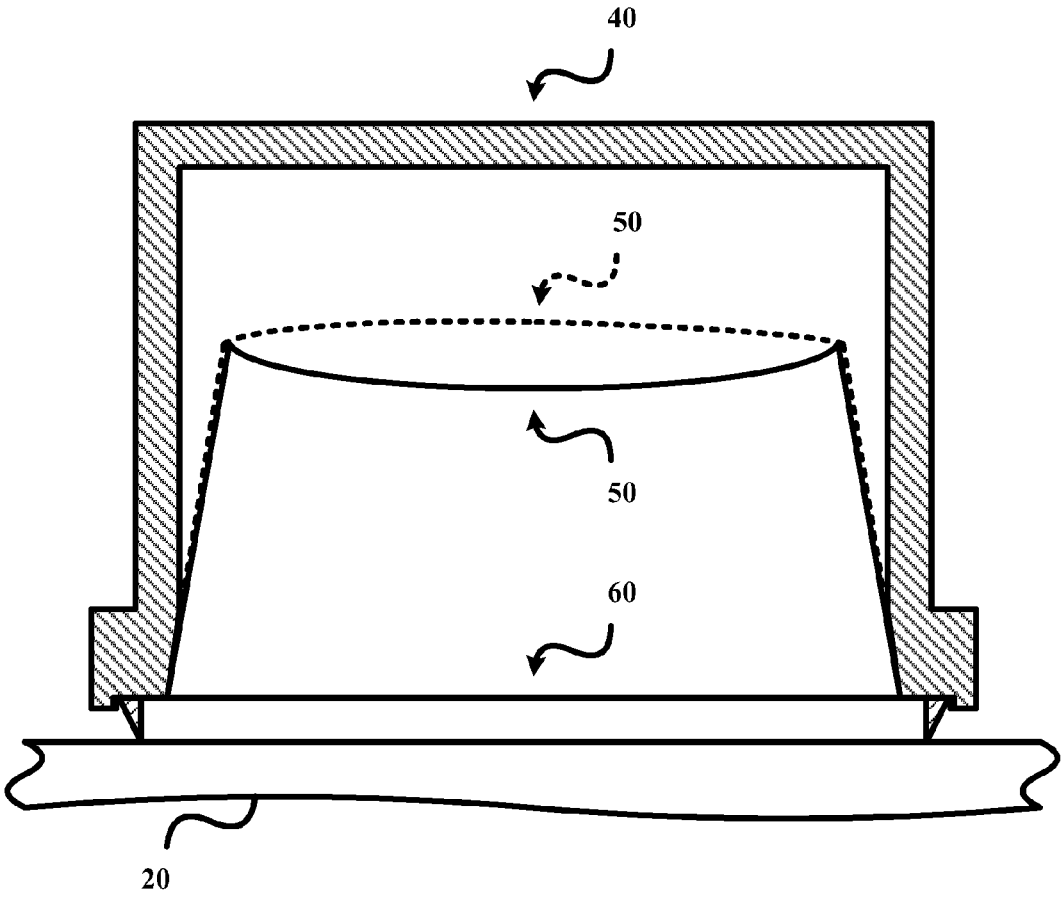
FIG. 3 illustrates a cross-sectional view of the liquid supply assembly illustrated in FIG. 1 in accordance with the present invention.

FIG. 2 illustrates an unassembled view of liquid supply assembly 30 and FIG. 3 illustrates an assembled view of liquid supply assembly 30 as placed on cliché plate 20. As shown in FIG. 2, reusable cup 40 includes a hollow reservoir body 41 having an open flanged outlet 42 and a closed base 43 defining a reusable liquid reservoir 44. As shown in FIG. 3, reusable liquid reservoir 44 has a size and shape for receiving disposable cup insert 50 therein.

As shown in FIG. 2, disposable cup insert 50 includes a hollow reservoir body 51 having an open flanged outlet 52 and a closed base 53 defining a temporary liquid reservoir 54 for holding a liquid within reusable liquid reservoir 54 (e.g., an ink/thinner mixture), and doctor ring 60 includes a hollow conduit body 61 having an open inlet 62 and an open outlet 63 defining a conduit 64. As shown in FIG. 3, reservoir 54 and conduit 64 are sized and shaped to facilitate a flow of liquid held by liquid reservoir 54 through conduit 64 when disposable cup insert 50 and doctor ring 60 are physically aligned.

Referring to FIG. 3, reusable cup 40, disposable cup insert 50 and doctor ring 60 can have any material composition suitable for holding and supplying liquid (e.g., ink) to cliché plate 20 as would be appreciated by those having ordinary skill in the art. In one embodiment, closed base 53 (FIG. 2) of disposable cup insert 50 has a flexible material composition (e.g., deformable plastic that is recyclable) that facilitates an expansion of liquid reservoir 54 as indicated by the dashed outline of disposable cup insert 50 in response to an increase in a gas pressure exerted by the liquid on liquid reservoir 54, such as, for example, an increase in the gas pressure by an ink/thinner liquid mixture on liquid reservoir 54 in view of an evaporation of the thinner from the ink/thinner liquid mixture held by liquid reservoir 54. In this embodiment, other portions of hollow reservoir body 51, such as open flanged outlet 52, can also have a flexible material composition.

Referring to FIG. 2, those having ordinary skill in the art will appreciate the need to provide a seal between the open flanged outlet 42 of reusable cup 40, open flanged outlet 52 of disposable cup insert 50 and doctor ring 60 to thereby prevent any side leakage of the liquid held by temporary reservoir 54. The present invention does not impose any limitations or any restrictions as to the structural configurations of open flanged outlet 42 of reusable cup 40 and open flanged outlet 52 of disposable cup insert 50 for purposing of facilitating such a seal. Thus, the following exemplary embodiments of a sealing configuration does not limit nor restrict the scope of structural configurations of open flanged outlet 42 of reusable cup 40 and open flanged outlet 52 of disposable cup insert 50 for purposing of facilitating a seal between the open flanged outlet 42 of reusable cup 40, open flanged outlet 52 of disposable cup insert 50 and doctor ring 60.

Figure 4:
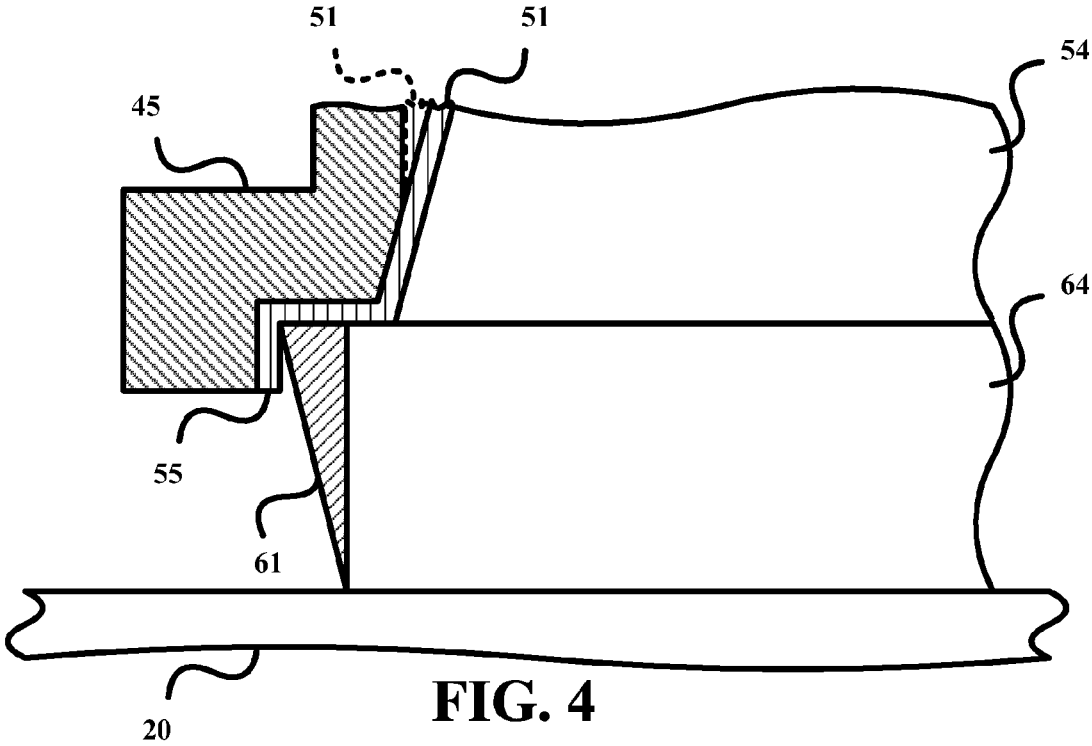
FIG. 4 illustrates a partial cross-sectional view of a first embodiment of a sealing configuration of the liquid supply assembly illustrated in FIGS. 2 and 3 in accordance with the present invention.

In a first sealing configuration embodiment, as shown in FIG. 4, the flange of open outlet 42 is in the form of a seat 45 and the flange of open outlet 54 is in the form of a seat 55. As assembled, seat 45 supports seat 55, which in turn supports conduit body 61 to thereby physically align liquid reservoir 54 with conduit 64. In this embodiment, a seal between seat 45 and conduit body 61 is formed by a press-fit technique as would be appreciated by those having ordinary skill in the art.

Figure 5:
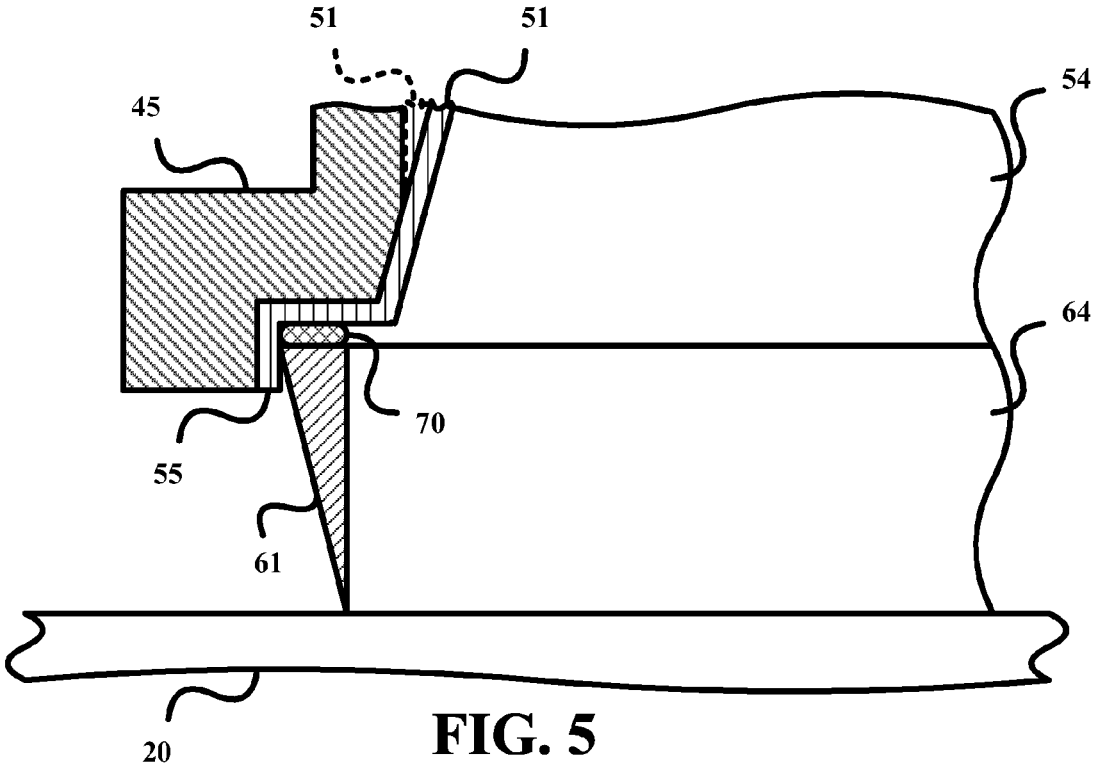
FIG. 5 illustrates a partial cross-sectional view of a second embodiment of a sealing configuration of the liquid supply assembly illustrated in FIGS. 2 and 3 in accordance with the present invention.

In second sealing configuration embodiment, as shown in FIG. 5, the flange of open outlet 42 is again in the form of seat 45 and the flange of open outlet 54 is again in the form of seat 55. As assembled, seat 45 supports seat 55, which in turn supports an O-ring 70 adjacent conduit 64 to thereby physically align liquid reservoir 54 with conduit 64. In this embodiment, O-ring 70 serves as the sole or primary seal as would be appreciated by those having ordinary skill in the art.

Figure 6:
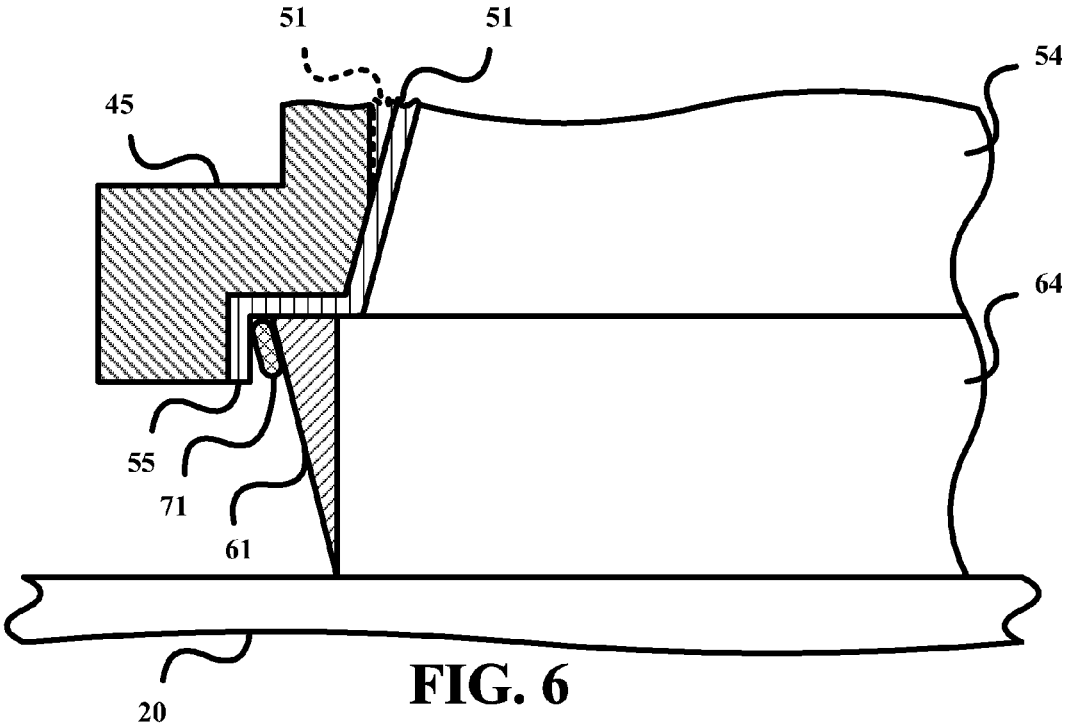
FIG. 6 illustrates a partial cross-sectional view of a third embodiment of a sealing configuration of the liquid supply assembly illustrated in FIGS. 2 and 3 in accordance with the present invention.

In a third sealing configuration embodiment, as shown in FIG. 6, the flange of open outlet 42 is again in the form of seat 45 and the flange of open outlet 54 is again in the form of seat 55. As assembled, seat 45 supports seat 55, which in turn supports an O-ring 71 adjacent an outer surface of conduit body 61 to thereby physically align liquid reservoir 54 with conduit 64. In this embodiment, O-ring 71 serves as the sole or primary seal as would be appreciated by those having ordinary skill in the art.

Figure 7:
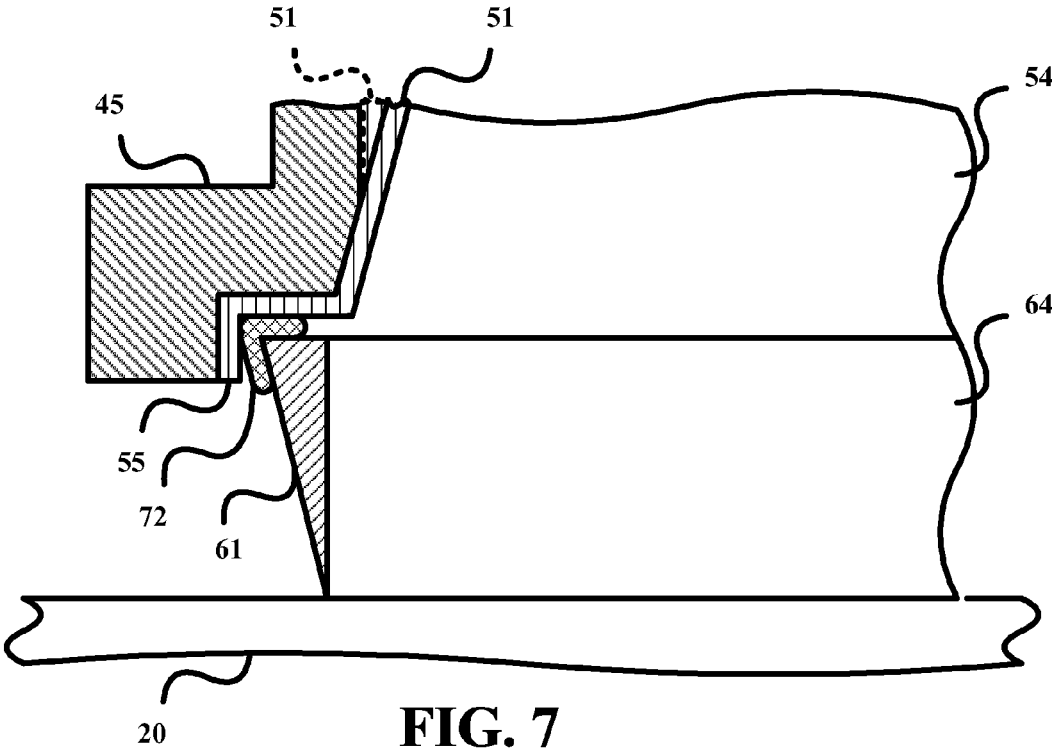
FIG. 7 illustrates a partial cross-sectional view of a fourth embodiment of a sealing configuration of the liquid supply assembly illustrated in FIGS. 2 and 3 in accordance with the present invention.

In a fourth sealing configuration embodiment, as shown in FIG. 7, the flange of open outlet 42 is again in the form of seat 45 and the flange of open outlet 54 is again in the form of seat 55. As assembled, seat 45 supports seat 55, which in turn supports an O-ring 73 adjacent conduit 64 and the outer surface of conduit body 61 to thereby physically align liquid reservoir 54 with conduit 64. In this embodiment, O-ring 73 serves as the sole or primary seal as would be appreciated by those having ordinary skill in the art.

Figure 8:
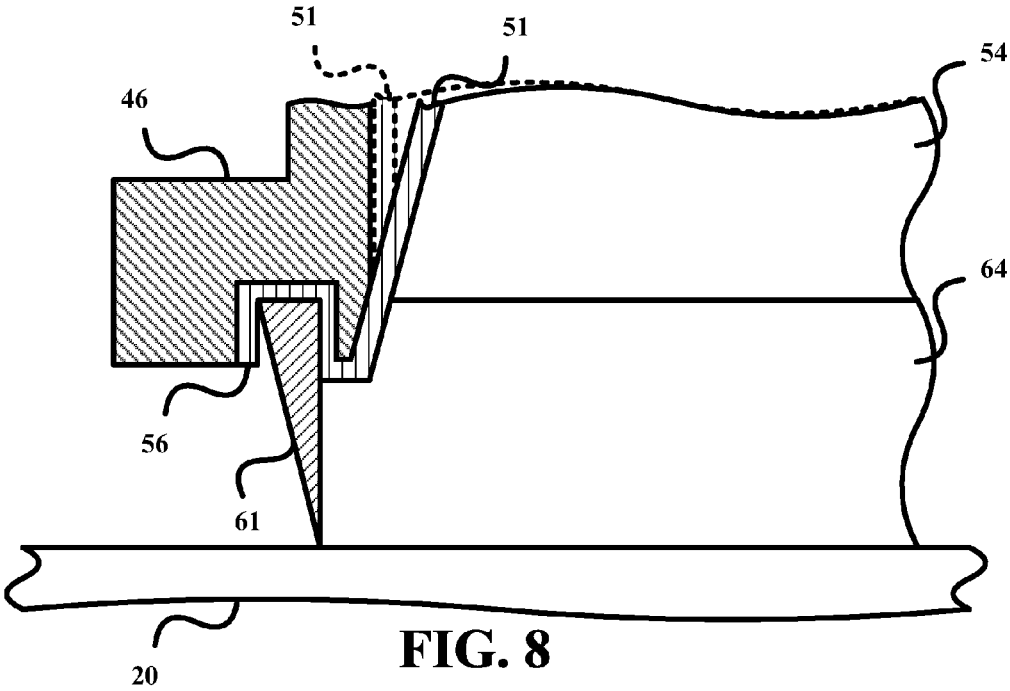
FIG. 8 illustrates a partial cross-sectional view of a fifth embodiment of a sealing configuration of the liquid supply assembly illustrated in FIGS. 2 and 3 in accordance with the present invention.

In a fifth sealing configuration embodiment, as shown in FIG. 8, the flange of open outlet 42 is in the form of a channeled seat 46 and the flange of open outlet 54 is in the form of a seal 56. As assembled, channeled seat 46 supports seal 56, which in turn encloses conduit 64 of conduit body 61 to thereby physically align liquid reservoir 54 with conduit 64. In this embodiment, seal 56 serves as the sole or primary seal as would be appreciated by those having ordinary skill in the art.

Figure 9:
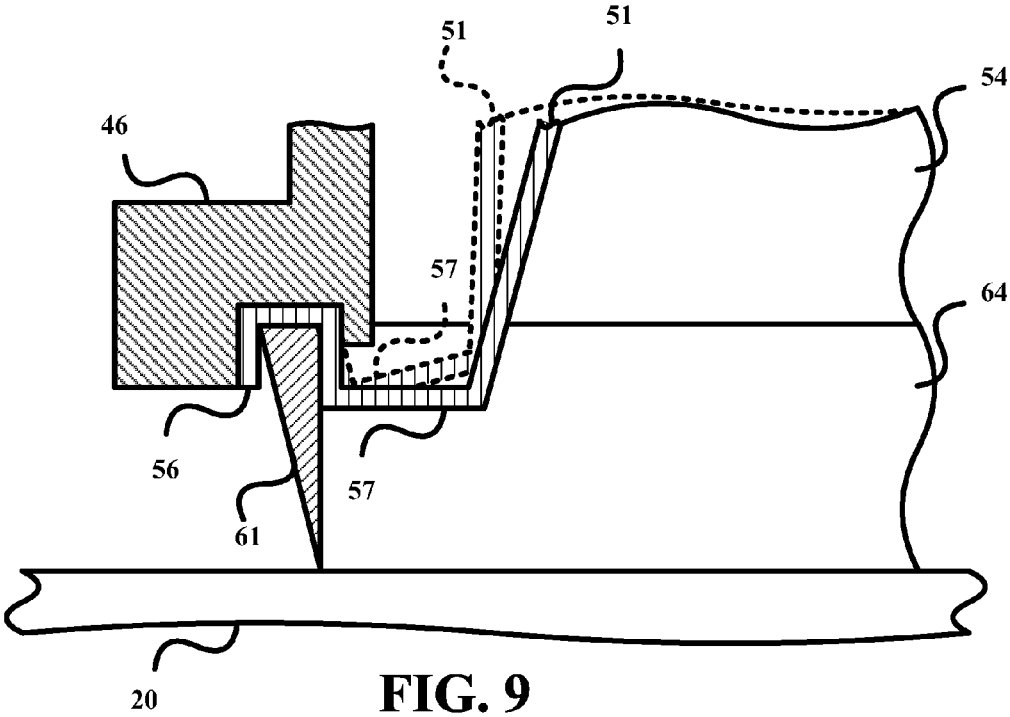
FIG. 9 illustrates a partial cross-sectional view of a sixth embodiment of a sealing configuration of the liquid supply assembly illustrated in FIGS. 2 and 3 in accordance with the present invention.

In a sixth sealing configuration embodiment, as shown in FIG. 9, the flange of open outlet 42 is again in the form of channeled seat 46 and the flange of open outlet 54 is in the form of seal 56 and a hinge 57. As assembled, channeled seat 46 supports seal 56, which in turn encloses conduit 64 of conduit body 61 to thereby physically align liquid reservoir 54 with conduit 64. Hinge 57 has a flexible material composition to facilitate an expansion of liquid reservoir 54 and more importantly, to facilitate a movement of conduit body 61 relative to disposable cup insert 50 due to imperfections in the surface contact between cliché plate 20 and conduit body 61 and to the pressurized environment within liquid reservoir 54. In this embodiment, seal 56 again serves as the sole or primary seal as would be appreciated by those having ordinary skill in the art.

Figure 11:
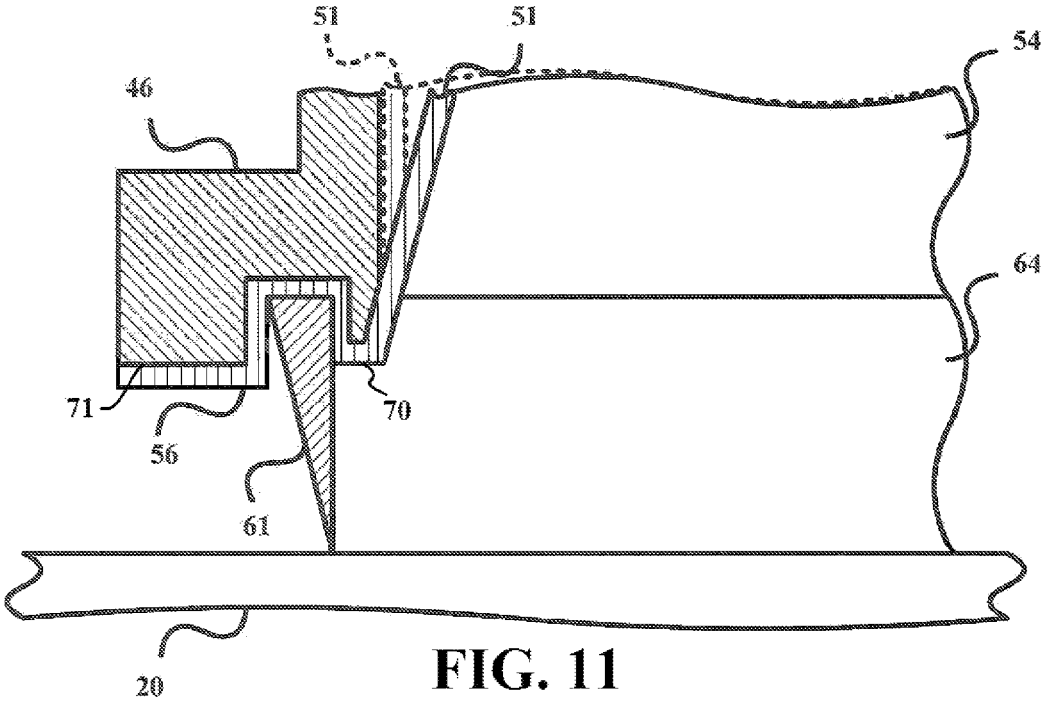
FIG. 11 illustrates a partial cross-sectional view of another embodiment of a sealing configuration of the liquid supply assembly illustrated in FIGS. 2 and 3 in accordance with the present invention.

In a seventh sealing configuration embodiment, as shown in FIG. 11, the flange of open outlet 42 is again in the form of channeled seat 46 and the flange of open outlet 54 is in the form of seal 56. In contrast to the fifth sealing configuration, the seventh sealing configuration includes an inner bottom portion 70 of seal 56 substantially collinear with an outer lower portion 71 of channeled seat 46. Additional stability is provided whereby seal 56 extends adjacent outer lower portion 71 of channeled seat 46. As assembled, channeled seat 46 supports seal 56, which in turn encloses conduit 64 of conduit body 61 to thereby physically align liquid reservoir 54 with conduit 64. In this embodiment, seal 56 serves as the sole or primary seal as would be appreciated by those having ordinary skill in the art. An orientation of the elements in such a fashion allows ink to flow substantially unimpeded to the edge of a scraping element, and allows better ink coverage of the image. In one embodiment, the reservoir body 51 includes an inner bottom portion 70 and an outer lower portion 71 separated by a recessed portion, such that the recessed portion is configured to mate with a conduit body, and the inner bottom portion 70 and an outer lower portion 71 are substantially collinear. In another embodiment, the reservoir body 51 includes an inner bottom portion 70 and an outer lower portion 71 separated by a recessed portion, such that the recessed portion is configured to mate with a conduit body, and the inner bottom portion 70 and an outer lower portion 71 are not substantially collinear. In another embodiment, the channeled seat includes a recessed portion separating an inner portion and an outer portion such that a lower surface of the inner portion is not collinear with a lower surface of the outer portion and each of the inner portion, recessed portion, and outer portion is configured to mate with a reservoir body holding ink.

Referring to FIGS. 4-8 and 11, the previous flange embodiments of open outlet 52 of disposable cup insert 50 can also have a flexible material composition to facilitate an expansion of liquid reservoir 54 as indicated by the dashed outline of reservoir body 51. Furthermore, disposable cup insert 50 may be supported by reusable cup 40 by any other technique as would be appreciated by those having ordinary skill in the art (e.g., friction and snaps).

Referring to FIGS. 1-8, those having ordinary skill in the art will appreciate many advantages of the liquid supply assembly of the present invention, including, but not limited to, a disposable cup insert nesting in a reusable cup to thereby hold liquid away from the reusable cup while permitting the normal use of the reusable cup by a pad printing system. The result is a significant reduction in labor, material and costs associated with a cleaning of the reusable cup.

Furthermore, for the sealing configuration embodiment shown in FIG. 9, those having ordinary skill in the art will appreciate that a suitable compressive engagement between cliché plate 20 and doctor blade 60 can be maintained over the circumference of doctor blade 60 irrespective of imperfections in the surface contact between cliché plate 20 and doctor blade 60 and irrespective of the pressurized environment within liquid reservoir 54.

One of skill in the art would appreciate that additional sealing configurations are possible within the scope of the invention as modifications or combinations of the presently illustrated embodiments.

Figure 10:
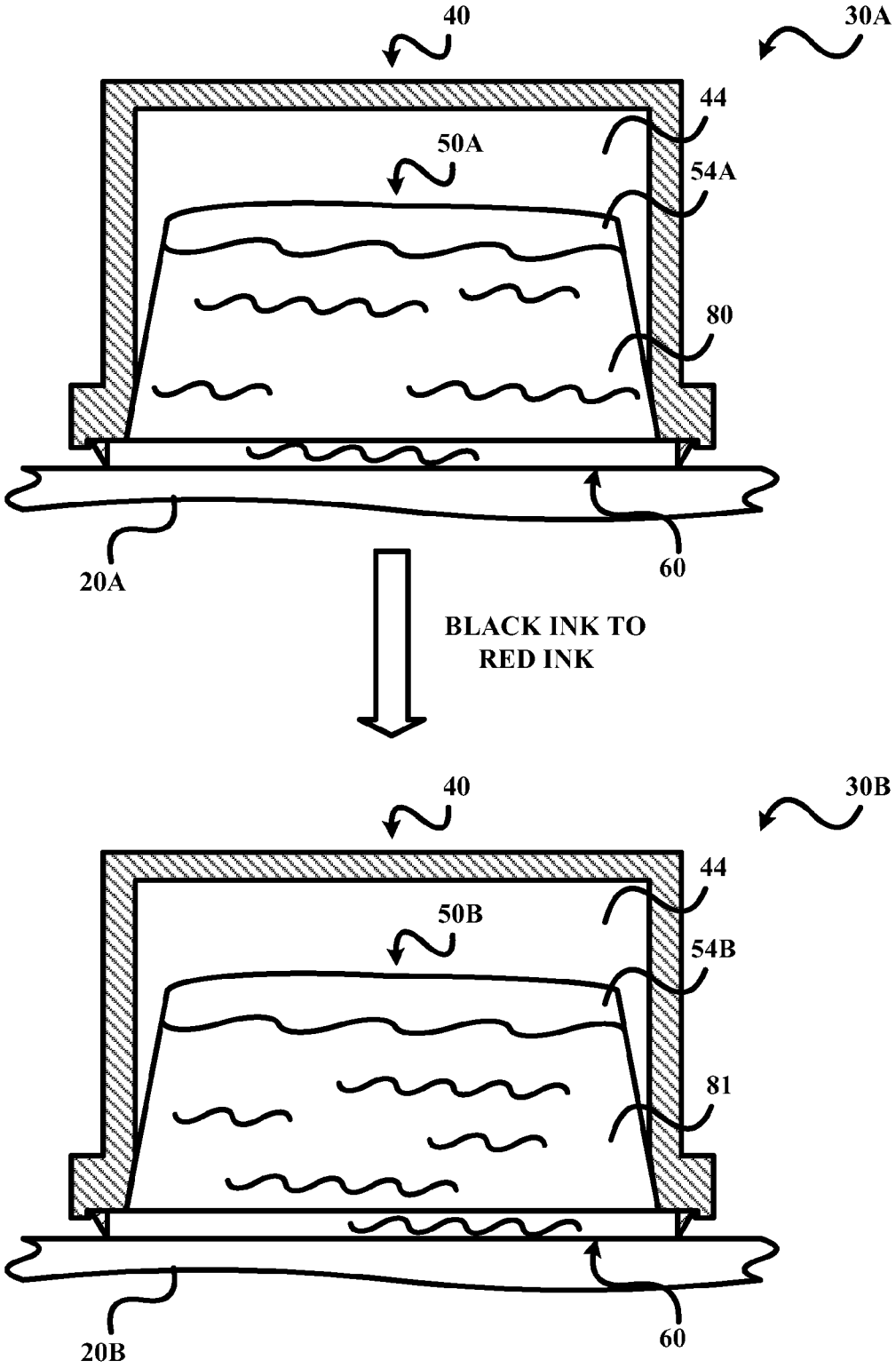
FIG. 10 illustrates an exemplary use of a pair of disposable cup inserts in accordance with the present invention.

FIG. 10 illustrates a further advantage of the present invention. Specifically, a black liquid supply assembly 30A includes a disposable cup insert 50A inserted into reusable liquid reservoir 44 of reusable cup 40 with its temporary liquid reservoir 54A holding a black ink/thinner liquid mixture 80 within reusable liquid reservoir 44. As such, black ink held by temporary liquid reservoir 54A can be deposited in a receiving region of cliché plate 20A and any excess of the black ink in the receiving region can be scraped from cliché plate 20A by doctor ring 60.

Upon a conclusion of a printing use of the black ink deposited in the receiving region of cliché plate 20A, another batch of the black ink/thinner liquid mixture 80 can be held by temporary liquid reservoir 54A within reusable liquid reservoir 44 for purposes of depositing more black ink in the receiving region of cliché plate 20A to thereby use the new batch of black ink in another printing process. Alternatively, black liquid supply assembly 30A can be disassembled with a removal of disposable cup insert 50A from reusable liquid reservoir 44, and a red liquid supply assembly 30B can be assembled with a disposable cup insert 50B being inserted into reusable liquid reservoir 44 of reusable cup 40 with its temporary liquid reservoir 54B holding a red ink/thinner liquid mixture 81 within reusable liquid reservoir 44. As such, red ink held by temporary liquid reservoir 54B can be deposited in a receiving region of cliché plate 20B and any excess of the red ink in the receiving region can be scraped from cliché plate 20B by doctor ring 60.

Upon a conclusion of a printing use of the red ink deposited in the receiving region of cliché plate 20B, another batch of the red ink/thinner liquid mixture 81 can be held by temporary liquid reservoir 54B within reusable liquid reservoir 44 for purposes of depositing more red ink in the receiving region of cliché plate 20B to thereby use the new batch of red ink in another printing process. Alternatively, red liquid supply assembly 30B can be disassembled with a removal of disposable cup insert 50B from reusable liquid reservoir 44, and another liquid supply assembly can be assembled with reusable cup 40 as taught herein.

All patents referred to herein, are incorporated herein by reference, whether or not specifically done so within the text of this disclosure.

In the disclosure, the words "a" or "an" are to be taken to include both the singular and the plural. Conversely, any reference to plural items shall, where appropriate, include the singular.

From the foregoing it will be observed that numerous modification and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims

The invention claimed is:

1. A liquid supply assembly for use with a printing system of a type in which a liquid is deposited from the liquid supply assembly in a receiving region on a plate and any excess of the liquid in the receiving region is scraped from the plate by the liquid supply assembly, the liquid supply assembly comprising:

a reusable cup including a reusable liquid reservoir;

a disposable cup insert including a temporary liquid reservoir operable to hold the liquid within the reusable liquid reservoir wherein the disposable cup insert includes a hollow reservoir body having an open outlet and a closed base defining the temporary liquid reservoir and wherein the closed base has a flexible material composition to facilitate an expansion of the temporary liquid reservoir in response to an increase in gas pressure exerted by the liquid on the temporary liquid reservoir; and a scraping element including a conduit operable to be in liquid communication with the temporary liquid reservoir and the plate to facilitate a flow of the liquid held by the temporary liquid reservoir through the conduit to the plate, wherein the open outlet includes a flange operable to be physically aligned with the scraping element to thereby establish the liquid communication between the temporary liquid reservoir and the conduit, and wherein the flange includes a seat operable to support a seal ring between the flange and the scraping element.

2. The liquid supply assembly of claim 1 wherein the reservoir body includes an inner bottom portion and an outer lower portion separated by a recessed portion, such that the recessed portion is configured to mate with a conduit body, and the inner bottom portion and an outer lower portion are substantially collinear.

3. The liquid supply assembly of claim 1 wherein the reservoir body includes an inner bottom portion and an outer lower portion separated by a recessed portion, such that the recessed portion is configured to mate with a conduit body, and the inner bottom portion and an outer lower portion are not substantially collinear.

4. The assembly of claim 1 wherein the disposable cup insert includes a closed upper portion and an open lower portion, and wherein the open lower portion rests upon the conduit, and wherein the conduit rests upon the plate.

5. A liquid supply assembly for use with a printing system of a type in which a liquid is deposited from the liquid supply assembly in a receiving region on a plate and any excess of the liquid in the receiving region is scraped from the plate by the liquid supply assembly, the liquid supply assembly comprising:

a reusable cup including a reusable liquid reservoir;

a disposable cup insert including a temporary liquid reservoir operable to hold the liquid within the reusable liquid reservoir wherein the disposable cup insert includes a hollow reservoir body having an open outlet and a closed base defining the temporary liquid reservoir; and a scraping element including a conduit operable to be in liquid communication with the temporary liquid reservoir and the plate to facilitate a flow of the liquid held by the temporary liquid reservoir through the conduit to the plate wherein the open outlet includes a flange operable to be physically aligned with the scraping element to thereby establish the liquid communication between the temporary liquid reservoir and the conduit, wherein the flange includes a seat operable to support a seal ring between the flange and the scraping element.

6. A printing system, comprising:

a plate including a receiving region; and a liquid supply assembly operable to deposit a liquid in the receiving region of the plate and to scrape any excess of the liquid in the receiving region from the plate, wherein the liquid supply assembly includes:

a reusable cup including a reusable liquid reservoir;

a disposable cup insert including a temporary liquid reservoir operable to hold the liquid within the reusable liquid reservoir wherein the disposable cup insert includes a hollow reservoir body having an open outlet and a closed base defining the temporary liquid reservoir; and a scraping element including a conduit operable to be in liquid communication with the temporary liquid reservoir and the plate to facilitate a flow of the liquid held by the temporary liquid reservoir through the conduit to the plate; and wherein the open outlet includes a flange operable to be physically aligned with the scraping element to thereby establish the liquid communication between the temporary liquid reservoir and the conduit, and wherein the flange includes a seat operable to support a seal ring between the flange and the scraping element.

7. A liquid supply assembly for use with a printing system of a type in which a liquid is deposited from the liquid supply assembly in a receiving region on a plate and any excess of the liquid in the receiving region is scraped from the plate by the liquid supply assembly, the liquid supply assembly comprising:

a reusable frame including a reusable liquid reservoir;

a disposable cup insert including a temporary liquid reservoir operable to hold the liquid within the reusable liquid reservoir wherein the disposable cup insert includes a hollow reservoir body having an open outlet and a closed base defining the temporary liquid reservoir;

a seal; and a scraping element including a conduit operable to be in liquid communication with the temporary liquid reservoir and the plate to facilitate a flow of the liquid held by the temporary liquid reservoir through the conduit to the plate, wherein the open outlet includes a flange operable to be physically aligned with the scraping element to thereby establish the liquid communication between the temporary liquid reservoir and the conduit, and wherein the flange includes a seat operable to support the seal between the flange and the scraping element.

8. The liquid supply assembly of claim 7 wherein the seal is disposed between the disposable cup insert and the reusable frame.

9. The liquid supply assembly of claim 8 wherein the closed base has a flexible material composition to facilitate an expansion of the temporary liquid reservoir in response to an increase in a gas pressure exerted by the liquid on the temporary liquid reservoir.

10. The liquid supply assembly of claim 7 wherein the seal is disposed between the disposable cup insert and the scraping element.

11. The liquid supply assembly of claim 10 wherein the closed base has a flexible material composition to facilitate an expansion of the temporary liquid reservoir in response to an increase in a gas pressure exerted by the liquid on the temporary liquid reservoir.

12. The liquid supply assembly of claim 7 wherein the closed base has a flexible material composition to facilitate an expansion of the temporary liquid reservoir in response to an increase in a gas pressure exerted by the liquid on the temporary liquid reservoir.

* * * * *